US005649708A

United States Patent [19]

Podlesny

[11] Patent Number: 5,649,708

[45] Date of Patent: Jul. 22, 1997

[54] TARGET AND METHOD

[76] Inventor: John T. Podlesny, Rte. 2 Box 92-A, Iron River, Wis. 54874

[21] Appl. No.: 529,754

[22] Filed: Sep. 18, 1995

[51] Int. Cl.[6] ..... F41J 3/00

[52] U.S. Cl. ..... 273/403; 273/408

[58] Field of Search ..... 273/403, 404, 273/405, 409

[56] References Cited

U.S. PATENT DOCUMENTS 3,163,418 12/1964 Myers ..... 273/408

5,308,084 5/1994 Morrell ..... 273/403

*Primary Examiner*—Mark S. Graham

[57] ABSTRACT

A roving material known as garnetted polyester, ideally a dacron base, can be manually laid up interiorly of a target case made out of vinyl-coated woven nylon is disclosed. The method of manufacturing the target is directed to first preparing the target by sewing the housing material to its general configuration but leaving a portion of the stitched area open but closable with a zipper or equivalent closure. Thereafter, the roving is manually plucked and the material laid up by hand interiorly of the target. Chopping and blowing the material will degrade the potential effect of the target in its absorption. Finally, a second casing like a pillow case with a longer zippered opening may be placed around the target when the original casing becomes shredded in the kill or bulls eye zone. In one embodiment, a deer silhouette is on one both sides with a contrasting colored kill zone. Another target is circular, optionally with a bulls eye on one side and cross haired center on the other. When a target is manufactured and is approximately twelve inches thick and two to three feet in diameter. The total weight of the target approximates ten pounds. The target itself will accept the bolt from a cross bow at a distance of ten yards and while the bolt will wedge into the target, it can be readily removed by two fingers. The same is true with a compound bow of any power utilizing a broad head or bodkin-type point which can also be dislodged from the target with two fingers.

10 Claims, 4 Drawing Sheets

TARGET AND METHOD

FIELD OF THE INVENTION

The present invention relates to targets, and more specifically the type of targets which are used by bow hunters for use with hunting point arrows or by cross bow hunters utilizing cross bow bolts with a hunting point.

BACKGROUND OF THE INVENTION

Archery has been with us for centuries. In the last quarter century, however, archery hunting through special archery seasons bring out bow hunters in abundance. The same is true for the compound archery bow, long bow, and even the cross bow. In order to polish their skills, these hunters practice throughout the year. Archery ranges are set up for tournaments in which a bullet head type point is employed. Seldom are the tournaments frequented by bow hunters with their broad head and bodkin-type points.

Indeed, one of the problems with the present straw or foam filled target is that a cross bow bolt will penetrate it and shred it badly. Alternatively, with a broad head or bodkin-type point on an archery bow of the compound type, the point will penetrate the target to a depth which makes it very difficult to dislodge, and which will eat the target at a great rate. Moreover, a hunting point loses its cutting edge after three to six shots into most conventional targets.

When the hunter practices with a target point, however, he may be shooting two or three inches off the mark from where he would be striking with the identical sight setting with his hunting point. There is an aerodynamic effect imparted to the arrow as well as the bolt by the hunting point. The action is to a degree akin to planing. As a result of the hunting point, the setting for target practice with a target point and a hunting point are not likely to be the same. What is needed, however, is a target which is durable, lightweight, weather resistant, and most particularly which will resist the penetration of a hunting point, but will not impede removal, whether the point be on an arrow or a bolt from a cross bow. Moreover such a target should be cost effective, sufficiently portable to be moved to storage area from a shooting range, weather resistant, and susceptible of being configured to a wide variety of targets such as a deer, rabbit, wild boar, and the like. The prior art is classified primarily in Class 273, subclasses 181R and 403. Exemplary of the prior art patents are the Morrell U.S. Pat. No. 5,308,084. It is formed of a burlap, and the interior fill is in a polyethylene bag which, in turn, has folded burlap for its interior portion. Also compressed cotton was employed. As will be seen with the present invention, significantly different materials are employed with vastly improved results when using a hunting arrow.

Pate U.S. Pat. No. 5,427,382 issued most recently. It is addressed to a repair kit, however, which stuffs a plurality of thermoplastic ribbon material into the holes on the target. The present invention is not directed to closing the holes in the target, but rather arresting the arrow quickly, and rendering it readily removable. In addition U.S. Pat. No. 4,477,082 to McKenzie relates to a three-dimensional target with the kill zone in a target segment which is primarily formed from a foam. Applicant's target differs in that a fibrous material is employed. Meyer U.S. Pat. No. 4,235,444 discloses a target with a plurality of layers as distinguished from being stuffed with a single fibrous material. Also polyethylene sheeting is employed, which is not used by the applicant. Finally, Olund U.S. Pat. No. 4,850,596 directs itself to a urethane foam cellular rubber as a target back stop, and does not necessarily teach a particular cover.

SUMMARY OF THE INVENTION

The present invention stems from the discovery that a roving material known as garnetted polyester, ideally a dacron base, can be manually laid up interiorly of a target case made out of vinyl-coated woven nylon. The method of manufacturing the target is directed to first preparing the target by sewing the housing material to its general configuration but leaving a portion of the stitched area open but closable with a zipper or equivalent closure. Thereafter, the roving is manually plucked and the material laid up by hand interiorly of the target. Chopping and blowing the material will degrade the potential effect of the target in its absorption. Finally, a second casing like a pillow case with a longer zippered opening may be placed around the target when the original casing becomes shredded in the kill or bulls eye zone. In one embodiment, a deer silhouette is on one both sides with a contrasting colored kill zone. Another target is circular, optionally with a bulls eye on one side and cross haired center on the other. When a target is manufactured and is approximately twelve inches thick and two to three feet in diameter. The total weight of the target approximates ten pounds. The target itself will accept the bolt from a cross bow at a distance of ten yards and while the bolt will wedge into the target, it can be readily removed by two fingers. The same is true with a compound bow of any power utilizing a broad head or bodkin-type point which can also be dislodged from the target with two fingers.

In view of the foregoing, it is a principle object of the present invention to develop a target for archers, irrespective of whether they are utilizing a long bow, compound bow, or cross bow which effectively accepts a hunting point from an arrow or a bolt without major penetration, and without securing the bolt or arrow to a degree that a major effort is required to remove the bolt or the arrow.

A further object of the present invention is to provide a target achieving the foregoing objective which is portable, and weather resistant.

Yet another object of the present invention is to achieve the foregoing objectives with a cost-effective target which can retail competitively with targets today which are inadequate for usage by the bow hunting practicing bower.

BRIEF DESCRIPTION OF THE ILLUSTRATIVE DRAWINGS

Further objects and advantages of the present invention will become apparent as the following description proceeds, taken in conjunction with the accompanying drawings, in which.

DESCRIPTION OF A PREFERRED EMBODIMENT

Figure 1:
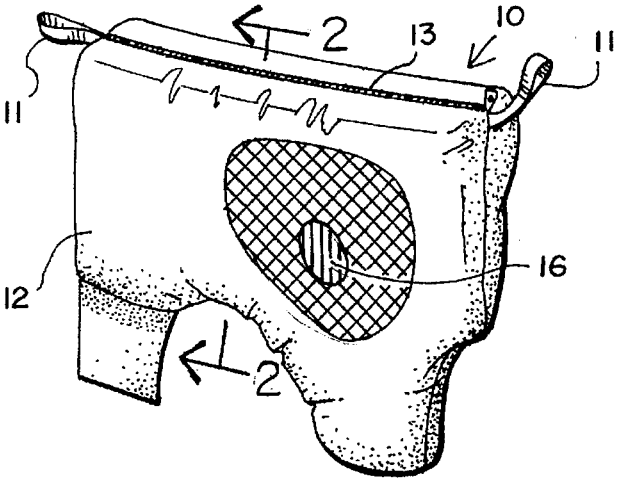
FIG. 1 is a perspective view of a target illustrative of the present invention positioned ready for use.
Figure 2:
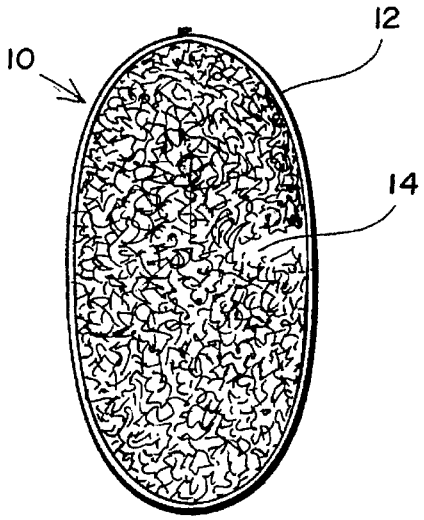
FIG. 2 is a vertical cut-away view of the target shown in FIG. 1 in enlarged scale illustrating the cross-section 2—2 of FIG. 1 of the material for the interior of the target as well as the target face and encasing material.
Figure 3:
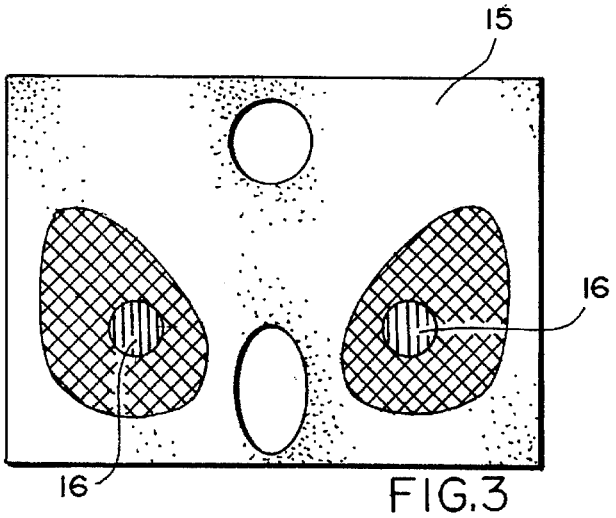
FIG. 3 is a plan view of the exterior fabric employed for forming the subject target.
Figure 4:
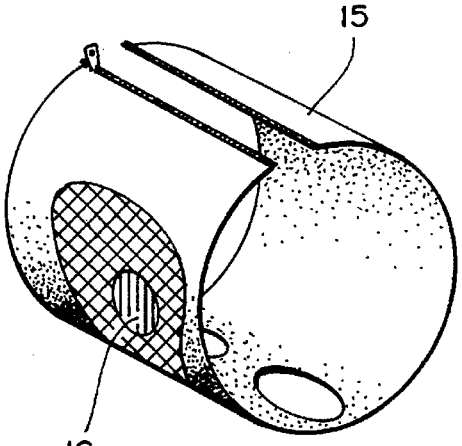
FIG. 4 is a view of a supplementary casing prior to encasing a target which has had several strikes in the kill zone.
Figure 5:
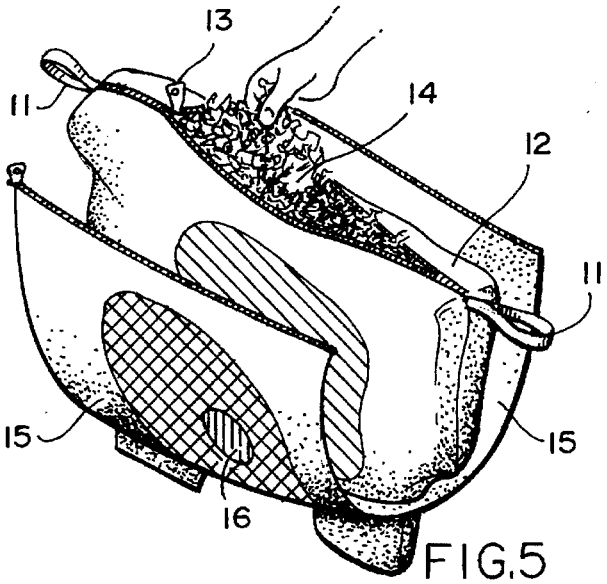
FIG. 5 is a partially diagrammatic view of a hand showing how the roving is plucked from the strand and subsequently laid interiorly of the target.
Figure 6:
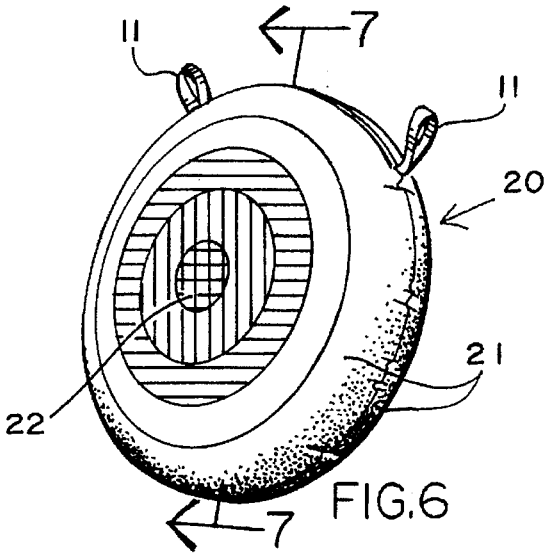
FIG. 6 is a perspective view of a bulls eye circular target employing the present invention.
Figure 7:
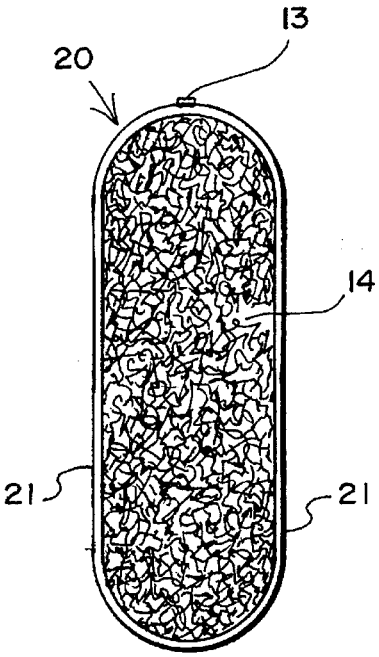
FIG. 7 is a vertical sectional view of the target shown in FIG. 6 taken along section line 7—7 of FIG. 6.
Figure 8:
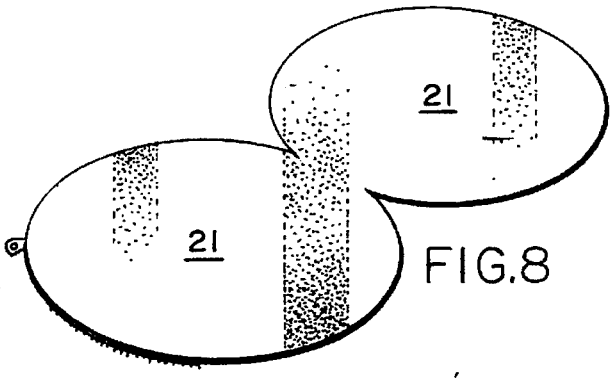
FIG. 8 is a showing of the casing for the target of FIG. 6 in the perspective and open position.
Figure 9:
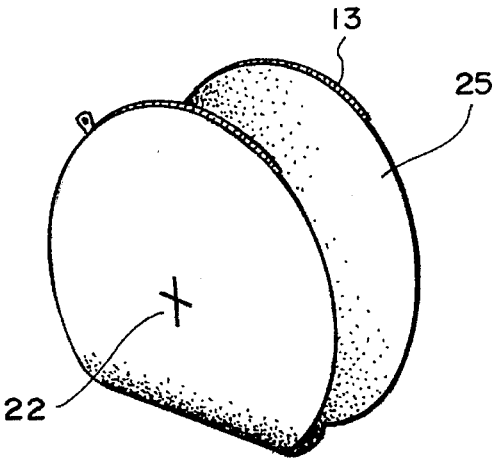
FIG. 9 is a perspective showing of the closing of the target as shown in FIG. 6 but without the adornment of the bulls eye.
Figure 10:
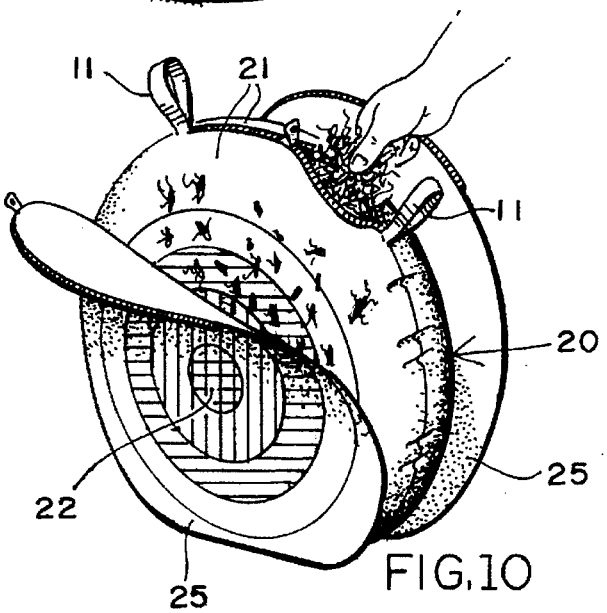
FIG. 10 illustrates how the extra casing is positioned around the basic target when the target face becomes shredded as a result of repeated impact.

The preferred embodiment target 10 as shown in FIG. 1 is made from a casing 12 as shown in FIG. 2, and an interior of roving 14 as shown in FIG. 2. It is secured for use by hang straps 11 on the upper end corners of the target casing 12.

The present invention of a target 10 as illustrated in FIG. 1 can be best understood by the problems faced with the prior art. Conventional targets with a bulls eye or game silhouette, whether made from straw or other materials, are normally intended for use by archers who are utilizing a target point on the arrow. The target point is essentially the same diameter as the arrow shaft, and accordingly has few or no aerodynamic characteristics. For the archer who goes hunting, he will use a broad head, or a bodkin with two or three blades, or other types of hunting points. These points resist the spiraling of the arrow which is normally provided by a slightly curvilinear fletching of the feathers at the tail portion of the arrow. The "rifling" thus obtained causes the target arrow to have a predictable trajectory. With the broad head point of an archery arrow, or a bodkin, or any other combination of blades in a hunting point, they resist the spiraling effect supplied by the fletching of the feathers at the rear portion of the arrow. The result is that upon initial flight, the arrow is inclined to plane and have a relatively flat trajectory until losing some of its initial velocity, whereupon its weight causes it to descend. Thus the profile of a target arrow in flight and the profile of a hunting arrow in flight, assuming identical aim, identical arrow, and identical bow, can vary as much as 12" vertically on a ten to twenty yard target. This is sufficient for the archer who is not practicing with his hunting arrow to miss the kill zone and the target being hunted, or indeed miss the target all together. Accordingly, many hunting archers, and particularly those using cross bows, would prefer to practice with a target that will permit them to use the hunting point. The problem with the present targets is that upon impact the hunting point will penetrate the target, and indeed sometimes will go straight through the target. When the hunting point impacts the state of the art target, oftentimes it takes two hands and maybe a foot pressing against the target to remove the arrow. In the process the target is partially mutilated. After fifty hits in the strike or kill zone, the target is rendered almost ineffective. In addition, the archer is distracted from the task at hand, which is shooting accurately with the hunting arrow, by the efforts required to dislodge the hunting arrow points from the target.

In view of the foregoing, the present invention has addressed itself to a target 10 which may be formed in the silhouette of a deer, or a traditional bulls eye target 20 which has a casing and a stuffing that will resist significant. penetration of a hunting point arrow or cross bow bolt. While we have disclosed a silhouette resembling a deer with a kill zone, and a bulls eye target, numerous other configurations are contemplated. For example the game could be a rabbit, turkey, boar, and even an elk. With the larger animal advantages of the invention are also exemplified in the lightweight, and yet portability for maneuvering to a shooting location. The discovery of the invention addressed to both a vinyl-coated woven nylon casing 12 employed for the outer portion of the target, and a garnetted polyester fine fiber matting 14 for the interior portion of the target. The matting 14 is desirably siliconized garnetted polyester, which causes the surface to by hydrophobic, moisture resistant, and slick in addition. For certain indoor applications, the silicon may be omitted.

Basically, the polyester fiber comes in four-foot cubes. Traditionally, such fibers can be combed and shredded and blown into pillows. Preferably, however, the fiber matting which is laid down in a convoluted pattern to form the four-foot cube is garnetted by a garnetted machine. The fibers are crimped and have an essentially a convoluted or serpentine configuration. When employed in a target, the polyester fiber of the present invention, or its equivalent, will arrest a broad head point shot by an archer with any compound bow at ten yards after a penetration of less than two to three inches, barely the length of the hunting arrow head. It is believed that the impact is resisted by a combination of the kinky or crimped fibers, as well as penetrating the casing which formed of a vinyl-coated closely woven nylon mat. Moreover, the ease in removing the hunting arrow point from the target is believed to be prompted by the loose nature of the fibers in combination of the silicon coating of the fibers which serves as a lubricant or release agent in the removal process.

Also contemplated by the invention is the utilization of a secondary casing or slip cover 15 which can be secured by means of a zipper 16 outside of the underlying target and applied initially for use, or after the kill zone has been shredded in the underlying casing 12. The underlying casing 12 normally is supplied with a primary zipper 13 for a sufficient area on a transverse access to permit stuffing the casing with the roving by hand. The zippers do not normally extend a full 180° around a circular target exemplary of the present invention, and on an embodiment resembling a deer silhouette, it runs down the top or the back of the deer for the principal portion of the length of the back or top.

The casing applied to the two embodiment of the present invention shown as a circular target and a deer silhouette is best shown in FIGS. 3, and 8–10. There will be seen that it is formed from a pair complementary panels which are stitched around the periphery, here shown as normal sewing machine stitching. The zipper of releasable securable fastener is similarly sewn in with a state-of-the-art sewing equipment and state-of-the-art stitchings.

More specifically, the materials include a ten ounce vinyl coated nylon for the casing, a No. 5 coil zipper for the zippers, one inch polypropylene straps, and the inside fill is a garnetted polyester fiber. More specifically, the outer casing, in one embodiment, is secured from Seaman Corporation, Industrial. Fabric Division at 1000 Venture Boulevard, Woster, Ohio 44691-6008 under the trademark "Shelter Right" Tarp 10. It weights ten ounces per square yard and is a synthetic. The fabric portion is a woven nylon. To the woven nylon, a vinyl coating is applied which subsequently can be printed with the target design desired.

Various fabrics have been the subject of experimentation with the following results:

| Type of Fabric Used: | Results: |
|---|---|
| 8 × 8 polyethylene coated polyethylene | Shredded too easily - cannot silk screen adequately |
| 12 × 12 polyethylene coated polyethylene | Less shredding than 8 × 8 but still too difficult to silk screen |
| 13 × 11 Polymesh | Fabric did not hold up |
| Poly-R Mesh (vinyl encapsulated Mesh) | Fabric did not hold up |
| 10 oz. Vinyl laminated nylon | Back side target shredded out |
| 14 oz. Vinyl laminated nylon | Back side badly shredded |
| 14 oz. Vinyl coated nylon | Acceptable but too heavy for most applications |
| 10 oz. Vinyl coated nylon | Acceptable for the bulk of the applications |

As to the stuffing various experimental activities were undertaken. They included:

| Type of Fiber Used: | Results: |
|---|---|
| Blown polyester fiber | Did not stop arrow |
| Blown recycled pop bottles | Did not stop arrow |
| Garnetted polyester fiber | Excellent |

As to siliconized and non-siliconized garnetted polyester, the siliconized fiber was preferable, particularly when outdoor usage was indicated.

The following are water test results of the target differentiating between siliconized and dry garnetted fiberglass:

1. 1 oz. silicon treated fiber and 1 oz. dry fiber were submerged in water, then lifted from the water and allowed to drain for exactly 60 seconds.

| | Silicon Treated | Dry |
|---|---|---|
| Weight before | 1 oz | 1 oz |
| | 7 1/2 oz | 14 1/8 oz. |

2. A small target was brought to a life guard at a local pool and he was asked to see how long it would hold him afloat in a capsized boat situation. He concluded that he was able to stay afloat for eight minutes and thirty seconds but if someone were really relaxed, the time could be much longer. Also, if someone was struggling harder than he tried to assimilate, the time could be much shorter.

The prior art teaches many materials for usage in archery targets. A few are set forth above. The stuffing employed ideally in the targets of the present invention may be described as garnetted polyester fiber fill in which garnetting provides maximum resiliency and top performance in fiber fill. Some fiber filled products are simply combed, picked, and bagged to be used as stuffing. Garnetting, a method of processing polyester, goes one step further. Each individual fiber is opened by mechanical combs and picks. Twenty-five wire cylinders work the fiber to provide an even layer of highly resistant fiber. Smooth opened fibers are all which is necessary for a reflexing refluffing-type stuffing. As mentioned, when the garnetted polyester fiber is siliconized, it reduces moisture absorption significantly, but does permit a slight degree of additional penetration by the broad head arrow. While emphasis has been made upon the use of two blade and three blade broad head hunting points, the advantages of the present invention are equally as important with a target arrow with a bullet-like target point. The target arrows will penetrate some two to three inches, and are very easy to withdraw. This contrasts to other standard targets known in the art where oftentimes withdrawal requires a significant application of force.

Exemplary of a stuffing or matting material is that purchased from Federal Foam Technologies of Minneapolis, Minn., Fiber Division. The product is basically a dacron polyester which can be a DuPont extruded, hollow or non-hollow. Most importantly, it should desirably be in a range of six to ten Denier which is fine. Basically the material is garnetted which results in combing, opening, and then webbing. According to the Material Safety Product Sheet, the polyester is basically a hydrocarbon with an additive of 5% of $TiO_2$. When the material is not garnetted, it will not absorb the hunting arrow point and the arrow will bury itself in the material. Generally speaking first quality virgin material is preferred, and desirably the strands are two and a half to three and a half inches. Strands down to one and a half inches are operable, but can result in waste, dust, and the like.

SPECIFIC EMBODIMENT

Figure 11:
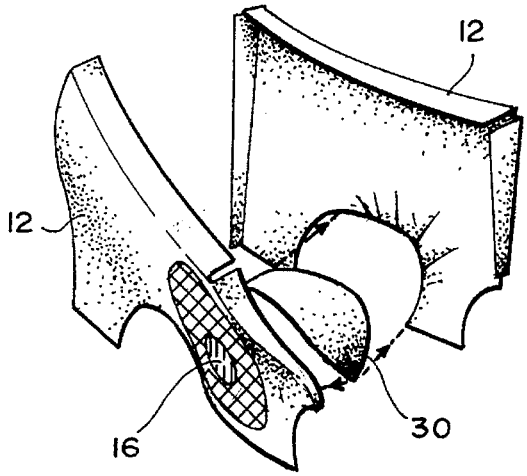
FIG. 11 is a more detail plan view of the target used for the simulated animal illustrating the tuck for a panel to increase the stuffing in the impact zone.

Turning now to FIG. 11 it will be seen that a pink lung section and a red heart section are designed to appear in the lower left-hand corner of the finished deer target as shown. While dimensions do not form a part of the invention they serve to illustrate the proportion, size, and utility of the product. The dimensions which have been selected for the deer target and bulls eye target are designed to conform to the United States Parcel Service (U.P.S.) minimal rates due to size and weight.

As it will be seen there is a pair of opposed eight inch hanging loops at both ends, with a zipper therebetween. The distance between the loops is twenty-eight inches. The flap is sewn under the zipper to prevent the fiber from binding onto the zipper. The vertical height at the left-hand side is sixteen inches to the cut-out for the leg, with the leg having a six inch dimension, both front and rear. The legs are stitched shut beneath the body portion to prevent fill from entering into them. The distance from the top of the target to the bottom of the leg is twenty-four inches, with the depth of the target approximating six inches.

For a regular deer 9.5 pounds of filling is employed. With the panel 30 (as shown in FIG. 11), this can be increased to 10.25 pounds. With the circular target to be described hereinafter, 4.5 pounds of filler are employed. It will also be noted that if the six inch by sixteen inch panel 30 is sewn between the "x's" commencing at the bottom of the front leg and terminating where the rear leg is stitched to the target and the closing stitch below the pink lung is left open, an additional three-quarters of a pound more fill can be added for a super-stuffed target, particularly desirable when utilizing a cross bow. Also, the coated nylon fabric can be upgraded to fourteen ounces for a target with added life.

Figure 12:
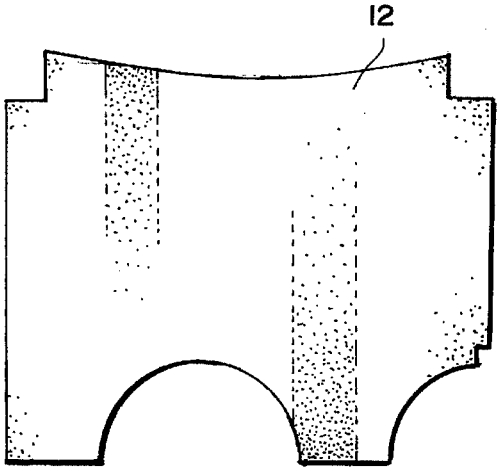
FIG. 12 is a plan view of the cut-out for one-half of the animal casing.

More specifically, turning to FIG. 12 it will be seen that the two deer panel sections are thirty-six inches wide, thirty inches high, with a one-half inch bow at the top and 3×3 inch out-outs in each of the upper corners. A 1×1 cut-out is provided in the lower corner in front of the front leg, followed by an eight and one-half inch drop to the bottom of the leg. The cut-out is approximately seven and one-quarter inches, with a leg having a seven and one-half inch length front to rear. The cut-out between the legs is on an eight inch radius. Again, the height of the entire panel is thirty inches and the width thirty-six inches.

Figure 13:
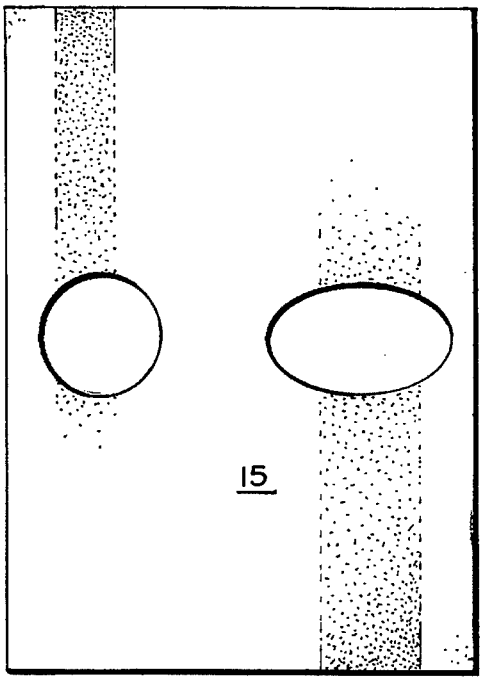
FIG. 13 is a plan view of the secondary replacement casing for the animal target as shown in FIG. 12.

The replacement cover for the deer is shown in FIG. 13 where it will be seen that the total width is thirty-nine inches and the height increased to thirty-one and one-half inches. The one and one-half inch bow remains the same at the top, and the 3×3 cut-outs remain the same in the upper corners, as well as the 1×1 cut-out the bottom front. Also, the leg sizes of seven and one-half and seven and one-half, the cut-out of an eight inch diameter, and the notch of one inch by one inch as well as the eight and one-half inch drop and seven and one-quarter inch recess to the bottom of the leg remains the same.

Figure 14:
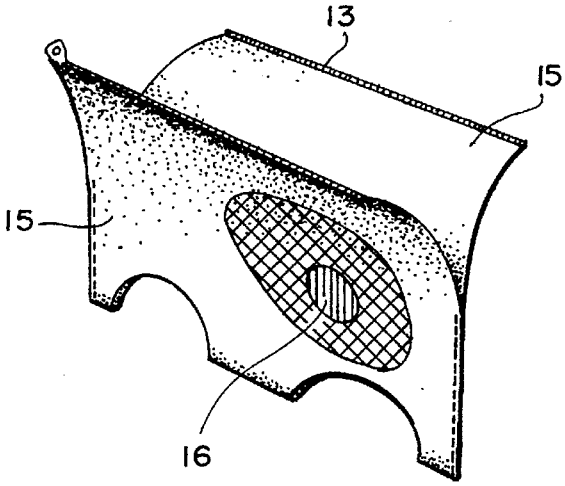
FIG. 14 illustrates the animal target and the areas stitched along with certain dimensions which relate to the replacement cover.

Finally, the finished deer replacement cover is shown in FIG. 14 where the dimensions are thirty-one inches from front to rear, twenty-five and one-half inches from top to bottom, with an approximate six inch depth. Both of the legs are stitched shut to prevent the fill from entering into them as with the underlying casing. The zipper is positioned at the top the same as the underlying target and approximates thirty-one inches long with eight inch hanging loops at either end.

Figure 16:
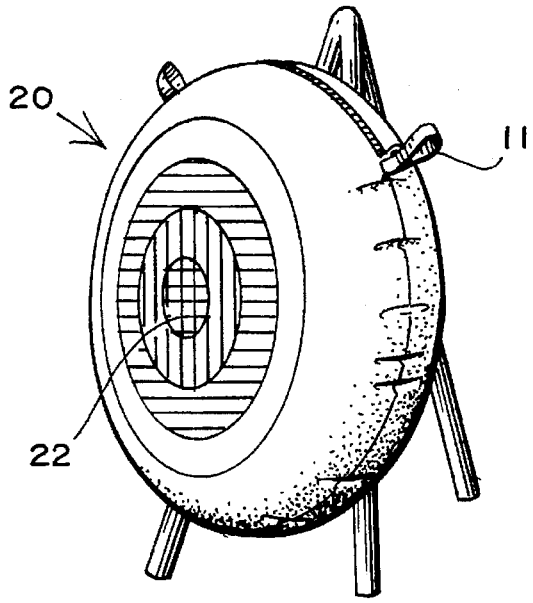
FIG. 16 is a further view of the circular target in its finished form.
Figure 15:
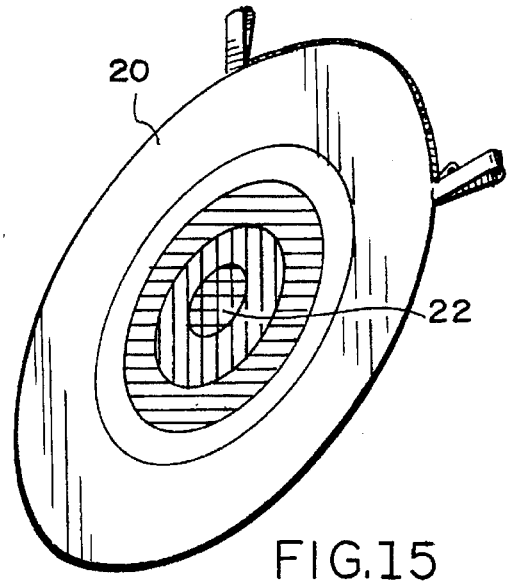
FIG. 15 is a view of the circular target.

The stopper or circular target is cut from a twenty-five inch diameter panel as shown in FIG. 15. FIG. 16 shows the finished circular target with a sixteen inch zipper at the top, a twenty inch nominal dimension along the diameter, and eight inch hanging loops spaced at the ten o'clock and two o'clock position.

Figure 17:
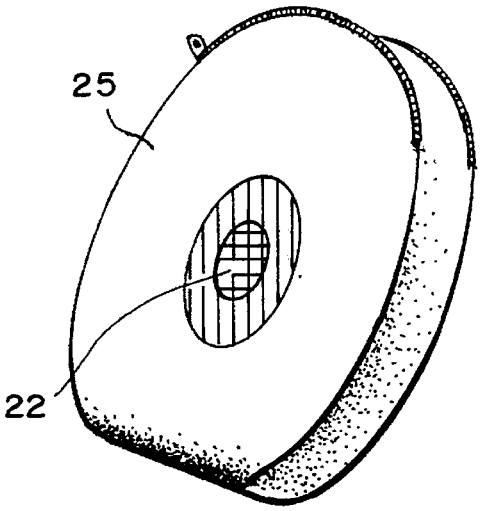
FIG. 17 is the replacement cover for the circular target.
Figure 18:
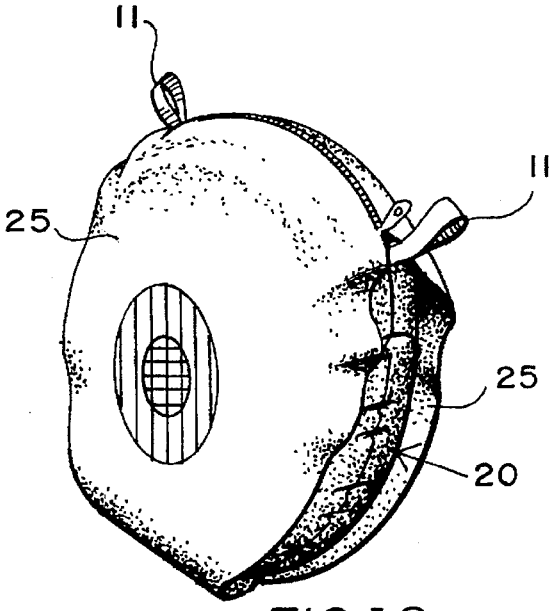
FIG. 18 is the finished view of the replacement cover for the circular target.

Finally, the replacement cover for the circular target in its panel form is shown in FIG. 17 which is cut to a twenty-seven inch diameter. Once the replacement cover for the circular target has been completed as shown in FIG. 18, there is a forty-eight inch zipper around the bottom, the total target with the replacement cover approximates twenty-two inches in diameter, and six to ten inches in depth.

THE METHOD

The present method of manufacturing the target 10 is relatively straight forward as illustrated in the Figures for forming the casing. The matting material, on the other hand, is normally stuffed from the rear of the deer silhouette forward. It is then zipped partially shut. Thereafter, the front area is manually stuffed very firmly. The area where the kill zone is located should be a dense as possible. While garnetted polyester fiber is the preferred material, and siliconized or not depending upon the application, the densities may vary. The goal is to, maintain a target weight of less than twenty pounds to render it highly portable, and yet sufficiently dense to resist penetration by the most adverse shooting circumstances.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. An archery target formed to a pre-selected silhouette which includes a casing having a removably securable lateral edge portion, and a matting stuffed interiorly of the casing, said target being characterized by:

said matting being selected from a garnetted polyester fiber having a denier of between six and ten, and, said casing being formed from a woven nylon material having a vinyl coating with a density of ten to sixteen ounces per square yard.

2. The archery target of claim 1, in which:

said garnetted polyester fiber is siliconized prior to insertion into the target.

3. The archery target of claim 1, in which:

hand strap support means are supplied at spaced opposed positions on said target, whereby the target can be easily hung for practice by securement to the two hand grip portions.

4. In combination with the archery target of claim 1, a supplemental casing having an essential silhouette in form of the underlying target and removable securing means along one portion thereof, whereby said removable casing can be placed over the underlying target when the kill zone becomes ineffective to retain the shape of the underlying target and kill zone for further usage as an archery target.

5. A method for forming an archery target having a casing and a matting comprising the steps of:

selecting the casing from a material comprising a nylon woven fabric which is vinyl coated having a density in the range of eight to sixteen ounces per square yard, forming the casing material to the silhouette of a target which has a removable securable lateral portion for stuffing, and stuffing the thus-formed target with a polyester fiber which has been garnetted and has a denier in excess of five and less than fifteen.

6. In the method of forming an archery target of claim 5, a step of providing a silicon treatment to the polyester fiber, whereby the fiber resists the absorption of moisture without significant reduction in its ability to absorb an archery arrow hunting point.

7. In the method of forming an archery target of claim 5, conforming the target to a body portion resembling an animal to be hunted in both size and configuration.

8. In the method of claim 7 above, applying a kill zone differentially appearing immediate to the silhouette.

9. In the method of claim 5 above, said silhouette resembling an animal having a front and rear portion and a kill zone area, said casing having an opening, said opening communicating with a cavity in the casing, stuffing the polyester fiber material firstly into the rear portion of the silhouette of an animal, thereafter partially closing the opening in the casing, and thereafter filling the balance of the cavity under manual weight pressure with an effort exceeding that of the rear portion, whereby the kill zone area will have a heavier density of polyester material.

10. A method for forming an archery target having a casing and a matting comprising the steps of:

selecting the casing from a material comprising a nylon woven fabric which is vinyl coated having a density in the range of eight to sixteen ounces per square yard, forming the casing material to the silhouette of a target which has a removable securable lateral portion for stuffing, said silhouette resembling an animal having a front and rear portion and a kill zone area, said casing having an opening, said opening communicating with a cavity in the casing, stuffing the thus-formed target with a polyester fiber which has been garnetted and has a denier in excess of five and less than fifteen, stuffing the polyester fiber material firstly into the rear portion of the silhouette of an animal, thereafter partially closing the opening in the casing, and thereafter filling the balance of the cavity under manual weight pressure with an effort exceeding that of the rear portion, whereby the kill zone area will have a heavier density of polyester material.

* * * * *